United States Patent [19]

Crowell

[11] Patent Number: 4,778,957

[45] Date of Patent: Oct. 18, 1988

[54] MERCURY FLOAT SWITCH

[75] Inventor: Gordon W. Crowell, Millville, N.J.

[73] Assignee: Raritan Engineering Co., Inc., Millville, N.J.

[21] Appl. No.: 58,416

[22] Filed: Jun. 5, 1987

[51] Int. Cl.[4] ..... H01H 35/18

[52] U.S. Cl. ..... 200/84 R; 73/317; 200/81.6; 340/625

[58] Field of Search ..... 73/308, 313, 317, 322.5; 200/81.6, 84 R, 81.9 HG, 190, 61.2, 230, 231, 302; 340/623, 625; 307/118

[56] References Cited

U.S. PATENT DOCUMENTS

| | | | |
|---|---|---|---|
| 2,816,973 | 12/1957 | Beck | 340/625 |
| 3,132,331 | 5/1964 | Boddy | 200/81.6 |
| 4,223,190 | 9/1980 | Olson | 200/84 R |

*Primary Examiner*—G. P. Tolin

*Attorney, Agent, or Firm*—John Cyril Malloy

[57] ABSTRACT

In one embodiment, the mercury float switch includes a sealed, partially mercury filled bent tube having two contact leads extending from one end. A shroud of plastic, injection molded material covers the portion of the tube where the two contact leads extend. The shroud is formed to have two opposing pivot arms extending therefrom. Each pivot arm encapsulates a respective lead. Connecting wires are electrically connected to each contact lead and the insulation surrounding the connecting wires is also encapsulated within a corresponding pivot arm. A foamed plastic, buoyant body completely encapsulates the tube as well as the shroud except for the ends of the pivot arms. This buoyant body is retained in a housing structure which has journals on opposing walls thereof which retain the pivot arms and allow the bouyant body pivot assembly to rotate freely on the pivots. The housing structure limits the rotational movement of the buoyant body. The connecting wires extend from the ends of pivot arms and are accessible from the exterior of the structure.

14 Claims, 1 Drawing Sheet

MERCURY FLOAT SWITCH

BACKGROUND OF THE INVENTION

The present invention relates to a float switch that turns ON and OFF dependent upon the level of fluid that is being measured by the switch.

In marine environments, float switches are commonly utilized to turn ON and OFF equipment based upon the detected level of fluid immediately surrounding the float switch. For example, if the float switch is mounted in a location that is subject to accumulation of bilge water, the float switch provides an indication of the level of bilge water. If the float switch is coupled between a power source and a bilge pump, the switch closes when the bilge water reaches a certain level. Hence, the bilge pump will be activated to discard the water overboard the vessel.

Other uses of float switches are to determine levels of any type of fluid such as fuel in a fuel tank, water in a water tank, etc.

OBJECTS OF THE INVENTION

It is an object of the present invention to provide a float switch which is highly durable given the nature of the liquid and particularly water acting on the float switch.

It is another object of the present invention to encapsulate the end of the glass envelope holding the mercury where the contacts exit from the envelope to prevent arcing of the switch contacts.

It is a further object of the present invention to doubly encapsulate that portion of the glass envelope.

It is another object of the present invention to utilize a glass envelope having two sections that are angularly displaced by an obtuse angle thereby obtaining a float switch which is not activated due to normal boat movement or vibration as is common in a sea way.

It is another object of the present invention to seal and retain contact leads by injection molded plastic in order to maintain the integrity of the leads and contacts protruding from the glass envelope.

SUMMARY OF THE INVENTION

In one embodiment, the mercury float switch includes a sealed, partially mercury filled tube having two contact leads extending from one end. A shroud of plastic, injection molded material covers the portion of the tube from where the two contact leads extend. The shroud is formed to have two opposing pivot arms extending from opposite sides thereof. Each pivot arm encapsulates a respective lead. A pair of connecting wires are electrically connected to the contact leads. The insulation of the connecting wires as well as the wire ends and electrical leads are encapsulated by the corresponding plastic pivot arms. A foamed plastic, buoyant body completely encapsulates the tube and the center area of the shroud allowing the pivot arms to protrude unencapsulated. This buoyant body is retained in a structure which has journals on opposing walls thereof which retain the pivot arms. The structure limits the rotational movement of the buoyant body. The connecting wires lead from the extensive ends of pivot arms and are accessible from the exterior of the structure.

BRIEF DESCRIPTION OF THE DRAWINGS

Further objects and advantages of the present invention may best be found in the following detailed description of the preferred embodiments when taken in conjunction with the accompanying drawings in which.

DETAILED DESCRIPTION OF THE PREFERRED EMBODIMENTS

The present invention relates to a mercury float switch that provides an indication of the level of liquid which acts upon the switch and particularly relates to a float switch useful in marine environments.

Figure 1:
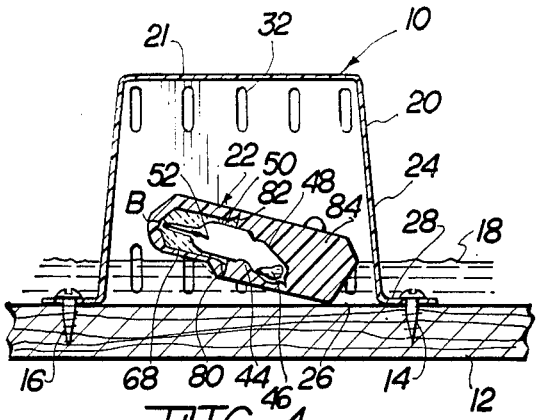
FIG. 1 illustrates a cross-sectional, side view of the float switch at a low water level in accordance with the principles of the present invention.
Figure 5:
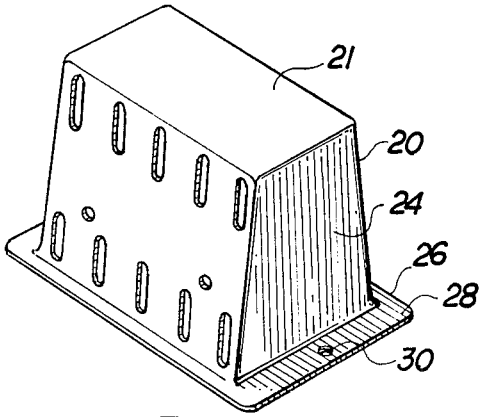

FIG. 1 illustrates a cross-sectional, side view of switch assembly 10 that is bolted to flooring 12 by screws 14 and 16. In this embodiment, water level 18 is not activating the switch. The switch assembly generally includes a housing 20 and a switch body 22. Similar numerals designate similar items throughout all the figures. With respect to housing 20, reference is made concurrently to FIGS. 1 and 5. Housing 20 includes roof 21 and in this embodiment, four side walls 24 rising from base 26. Base 26 includes outwardly extending flange 28. Screws 14 and 16 are adapted to respectively pass through a pair of apertures, one of which is aperture 30 in flange 28 (see FIG. 5).

A plurality of slots, holes or apertures 32 are present in opposing side walls at an upper location as well as a lower location with respect to pivot journals 95 and 97. The lower set of apertures allows the ingress and egress of water and the upper set of apertures, in addition to this fill and drain feature, allows air to pass in and out of the switch assembly. The specific size of housing 20 as compared with switch body 22 is discussed later with respect to FIG. 4.

Figure 4:
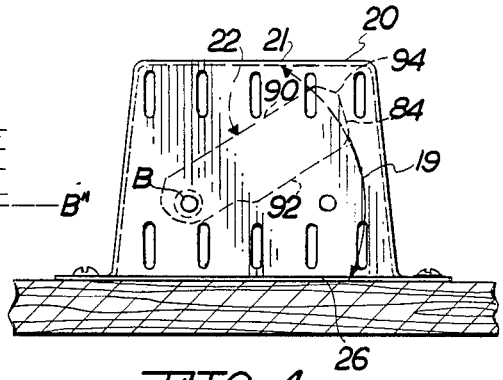
FIG. 4 illustrates a side view of the switch assembly and particularly the rotational limits of the switch body; and, FIG. 5 illustrates a perspective view of the switch housing.

Switch body 22 rotates within housing 20 along arc 19 shown in FIG. 4. Switch body 22 rotates around pivot arms 40 and 42 that laterally extend from the switch body generally near one end of the body.

Switch body 22 includes a glass envelope 44, preferably evacuated, having mercury globule 46 that partially fills sealed glass envelope 44. The glass envelope or tube generally includes two sections, section 48 that is remote from pivot axis B. The forward tube section 50 is nearer pivot axis B. Aft section 48 is disposed at an obtuse angle with the respect to fore section 50. Pivot axis B passes through the center line of pivot arms 40 and 42 and is coextensive with imaginary line B'–B" in FIG. 3. In a preferred embodiment, the fore section is angularly displaced from the aft section by approximately 135 degrees.

Figure 2:
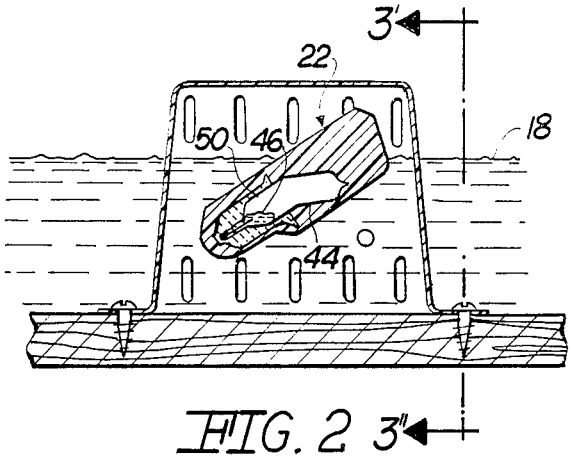
FIG. 2 illustrates a cross-sectional, side view of the float switch at a high water level.

A pair of contacts 52 and 54 (see FIG. 3) are proximate each other but spaced apart in the interior of fore section 50. When mercury globule 46 is in fore section 50 of glass envelope 44, contacts 52 and 54 are electrically connected. in FIG. 2, mercury globule 46 is positioned in fore section 50 due to the buoyancy of switch body 22 and the high level 18 of the water.

The angular displacement between the fore and aft sections of the glass envelope prevents the switch from being activated by the pitch, yaw and roll of the water craft. The smaller the obtuse angle, the less responsive the switch will be to those factors. It is estimated that the upper and lower limits of the obtuse angular displacement is approximately 158 degrees and 114 degrees. If the float switch is utilized in conjunction with a bilge pump system, the angular displacement of the glass tube sections would limit oscillatory operation of the bilge pump due to the movement of the boat and hence the sloshing of the bilge water effecting switch body 22.

Figure 3:
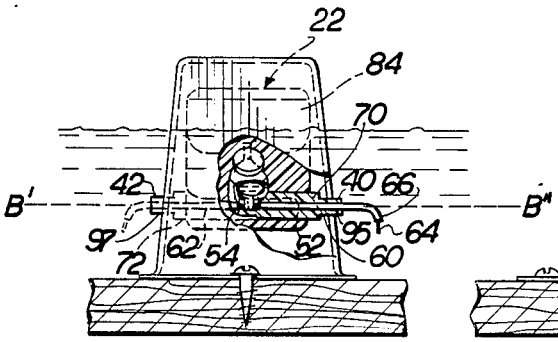
FIG. 3 illustrates a rear view of the switch assembly having a partially broken away, cross-sectional view of the internal elements of the switch.

Contacts 52 and 54 not only protrude into the interior of glass envelope 44, but also protrude through the tube such that those leads are electrically connected to connecting wires 60 and 62 as shown in FIG. 3. These connecting wires include one or more electrically conductive wires 64 that is covered by insulation 66.

Glass envelope 44 is partially enshrouded by shroud 68 at fore section 50 and particularly where contact leads 52 and 54 extend from the glass envelope. In a preferred embodiment, shroud 68 is a plastic material such as polyethylene that is injection molded around glass tube or envelope 44. Also in this embodiment, glass tube 44 is supplied by Gordos Corporation. By enshrouding fore section 50 of glass envelope 44, the leads are encapsulated by the plastic shroud. Also, connecting wires 60 and 62 are partially enshrouded by the plastic since the shroud forms opposing shoulders 70 and 72 as well as pivot arms 40 and 42 that extend from shoulders 70 and 72. The electrical connection between leads 52 and 54 respectively with contact wires 60 and 62 is encapsulated by injection molded shroud 68.

The wires run generally coextensive with pivot axis B and extend outward from the most extensive ends of pivot arms 40 and 42. The molding of shroud 68, shoulders 70 and 72 and pivot arms 40 and 42 encapsulate the electrical wires to obtain an integral structure that is impervious to water, contaminants, salt and other chemicals commonly found in bilge water. Further, the pivot arms, shoulders and shroud seal and retain both the connecting wires, the leads and the solder connection therebetween thereby substantially reducing the possibility of arcing or completely preventing such arcing between the leads and wires.

Shroud 68 may enclose the entire surface portion of glass tube 44.

Shroud 68 also includes wings or ears 80 and 82 which are utilized to position the glass tube and shroud while a float 84 is molded about the tube and the shroud. Float 84 can be any element that floats, such as cork, balsa or various plastics. In the preferred embodiment, float 84 is a closed cell, foam plastic float and wings 80 and 82 position the integral envelope and shroud in the mold such that the plastic, buoyant material completely encapsulates the shroud and the tube with the exception of a slight portion of shoulders 70 and 72 and pivot arms 40 and 42. The use of plastic float 84 provides a double encapsulation of glass envelope 44, the contact leads 52 and 54 as well as shroud 68. This further prevents arcing between the leads and water intrusion.

Float 84 is generally rectangular in shape and has an upper surface 90 and a lower surface 92. The thickness of the float, the distance between upper surface 90 and lower surface 92, the precise positioning of pivot axis B with respect to roof 21 and base 26 as well as the length of the float from pivot axis B to side 94 remote therefrom is such that the switch body cannot rotate more than 90° degrees. The relationship between these various dimensions determines the angular size of arc 19.

Journal means are mounted on the side walls of housing 20 and include journals 95 and 97 through which extend pivot arms 40 and 42. The cooperation of journals 95 and 97 and pivot arms 40 and 42 allow switch body 22 to rotate through arc 19 within housing 20.

The claims appended hereto are meant to cover modifications and changes within the scope and spirit of the present invention. For example, housing 20 may be replaced by an inverted "U" shaped housing as long as upper and lower stops are provided to limit the rotational movement of switch body 22. The sides of the inverted "U" shaped housing would have the journals within which rotate pivot arms 40 and 42.

In the preferred embodiment, housing 20 is made of a crush proof, plastic material. As used herein, the term "crush proof" means a material that can withstand a person stepping on the structure without collapse of the structure and also means that hand tools could be dropped on the structure without collapse of that structure. In its basic embodiment, float 84 need not be part of the invention if shroud 28 plus glass envelope 44 were buoyant. The housing can be a formed vacuum-molded plastic. It is noted that connecting wires 60 and 62 are only accessible from the exterior of the housing thereby enabling easy installation of the entire switch assembly. The shroud could encapsulate the entire glass envelope and this concept is meant to be covered by the claims appended hereto.

These and other modifications and changes are covered by the appended claims.

What I claim is:

1. A mercury float switch comprising:

(a) a sealed, partially mercury filled tube having two contact leads mounted on the tube and extending therein from substantially adjacent one end thereof, a float means coupled to an opposite end of said tube for rendering said tube buoyant, (b) a housing structure including at least a base portion and a roof portion and further structured to allow passage of air and water into and out of an interior thereof, (c) said tube mounted within said housing structure between said roof portion and said base portion, said roof portion overlying said tube a spaced distance from said base portion, (d) a shroud of material covering an external portion of said tube in at least partially surrouding relation to said one end of said tube adjacent said two contact leads, (e) a connecting wire electrically connected to each of said contact leads and extending through said shroud of material to a location external of said housing structure, (f) journal means mounted on said housing structure and connected to said tube substantially adjacent said one end for rotationally mounting said tube and float means within said housing structure, (g) said spaced distance between said roof structure and said base structure defining an interior height dimension of said housing structure and providing respectively, upper and lower stops limiting rotation of said tube and float means, and (h) whereby the rotational position of said one end of said tube with respect to an opposite end thereof determines whether said two contact leads are electrically connected via the mercury.

2. A mercury float switch as claimed in claim 1 wherein said shroud includes wing-like protrusions that cooperate to position the shroud and the partially enshrouded tube in a mold that forms said foamed plastic body.

3. A mercury float switch as claimed in claim 1 wherein said shroud is made of water impervious, injection molded plastic, said molded plastic seal and retain said connecting wires.

4. A mercury float switch as claimed in claim 3 wherein said molded plastic is impervious to water, solvents, fuel and contaminants carried by said water commonly found in a bilge.

5. A mercury float switch as claimed in claim 4 wherein said plastic is polyethylene.

6. A mercury float switch as claimed in claim 1 wherein said tube comprises:

a sealed glass envelope having a first longitudinal portion angularly displaced from a second longitudinal portion at an obtuse angle;

a pair of electrical contacts as said two contact leads having proximal ends spaced from each other and distal end sections extending through said glass envelope;

a mercury globule inside said glass envelope adapted to electrically connect or disconnect the proximal ends of said contacts dependent upon the rotational position a first extensive end of said first position with respect to a second extensive end of said second portion of said glass envelope.

7. A mercury float switch as in claim 1 wherein said shroud comprises two opposing pivot arms each of which encapsulate a different one of said contact leads exteriorly of said tube.

8. A mercury float switch as in claim 7 wherein said journal means includes two journal structures each mounted on said housing structure and each disposed in surrouding relation to a different one of said pivot arms, said pivot arms rotationally mounted within a respective one of said two journal structures and rotatably supporting said tube and float means within said housing structure.

9. A mercury float switch as in claim 1 wherein said float means is a formed plastic buoyant body disposed in encapsulating relation to said tube and said shroud.

10. A mercury float switch at least partially enshrouded in a rigid shroud made of plastic material having sufficient wall thickness to insure its structural integrity but not so thick as to render it unduly heavy, said shroud completely covering and insulating a pair of switch terminals outside a glass mercury capsule, said shroud enclosing a pair of electrical wire leads externally of said glass capsule, said electrical wire leads mounted at least partially within said glass capsule and respectively electrically connected to said pair of switch terminals, said wire leads being partially longitudinally enclosed within respective switch pivot arms defining an integral part of said shroud, said glass capsule pivotally mounted by said two pivot arms that contain the conductive wires that extend the length of a respective pivot arm, said pivot arms extending through opposing walls to an exterior of a box-like support which has apertures therethrough providing air venting at the top-most portion and water ingress and egress at the bottom-most portion of the opposing walls, said box-like support being made of a crush-resistant material having sufficient mechanical strength to adequately protect the switch assembly from accidental damage by force being applied thereto, said box-like support including an upper horizontal closure at such height above a base closure so as to prevent the glass capsule from rotating excessively past the point where the switch is in an ON mode, and wherein a rotational access about the pivot arms being of such height above said base of the box-like support that said glass capsule cannot rotate toward an OFF mode more than is necessary to fully open the switch contacts with a mercury globule in an opposite end of the glass capsule with respect to said pair of electrical wire leads spaced from each other in said glass capsule.

11. A mercury float switch as in claim 10 wherein injection molded pivot arms partially, longitudinally enclose the connecting electrical wire leads externally of said glass capsule and provide a water-tight seal for the two switch terminals.

12. A mercury switch as claimed in claim 10 wherein the shroud has a positioning means extending from a shroud body to assure that the glass mercury switch will be properly secured or oriented within a float means for buoyancy.

13. A mercury switch as claimed in claim 12 wherein said positioning means is a pair of wings protruding from opposite sides of said shroud body.

14. A mercury switch as claimed in claim 10 wherein said shroud in an injection molded, rigid plastic shroud of a material that is both impervious to water, and contaminants such as bilge oils and any engine fuels, said shroud being mounted within or attached to a suitable float.

* * * * *